US009243382B2

(12) United States Patent
Yamazaki

(10) Patent No.: US 9,243,382 B2
(45) Date of Patent: Jan. 26, 2016

(54) RIPPER DEVICE FOR MOTOR GRADER, AND MOTOR GRADER EQUIPPED WITH THIS DEVICE

(71) Applicant: KOMATSU LTD., Tokyo (JP)

(72) Inventor: Eiji Yamazaki, Komatsu (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/360,745

(22) PCT Filed: Feb. 13, 2014

(86) PCT No.: PCT/JP2014/053358
§ 371 (c)(1),
(2) Date: May 27, 2014

(87) PCT Pub. No.: WO2014/188745
PCT Pub. Date: Nov. 27, 2014

(65) Prior Publication Data

US 2015/0152623 A1 Jun. 4, 2015

(30) Foreign Application Priority Data

Nov. 8, 2013 (JP) ..... 2013-232051

(51) Int. Cl.
*E02F 5/32* (2006.01)
*E02F 3/80* (2006.01)
*E02F 3/76* (2006.01)

(52) U.S. Cl.
CPC ..... *E02F 5/32* (2013.01); *E02F 3/7604* (2013.01); *E02F 3/80* (2013.01)

(58) Field of Classification Search
CPC ..... A01B 15/025; A01B 13/08; A01B 13/10; A01B 13/12; E02F 5/32
See application file for complete search history.

(56) References Cited

U.S. PATENT DOCUMENTS

| | | | | | |
|---|---|---|---|---|---|
| 2,797,629 | A * | 7/1957 | Kelley | 172/488 |
| 3,266,816 | A * | 8/1966 | Peterson et al. | 280/410 |
| 3,552,497 | A * | 1/1971 | Stedman | 172/292 |
| 3,870,106 | A * | 3/1975 | Gosling et al. | 172/239 |
| 4,103,443 | A * | 8/1978 | Pelsy | 37/370 |
| 4,219,947 | A * | 9/1980 | Paladino | 37/370 |
| 8,490,711 | B2 * | 7/2013 | Polumati | 172/484 |
| 8,752,643 | B2 * | 6/2014 | Shekleton et al. | 172/699 |
| 2008/0245540 | A1 | 10/2008 | Shekleton et al. | |
| 2013/0161036 | A1 | 6/2013 | Polumati | |

FOREIGN PATENT DOCUMENTS

| | | | |
|---|---|---|---|
| GB | 2 049 383 | A | 2/1983 |
| JP | 50-15368 | Y1 | 5/1975 |
| JP | 55-145221 | A | 11/1980 |
| JP | 5-49851 | U | 7/1993 |
| WO | 2013/095915 | A1 | 6/2013 |

OTHER PUBLICATIONS

The International Search Report for the corresponding international application No. PCT/JP2014/053358, issued on May 20, 2014.

* cited by examiner

*Primary Examiner* — Matthew D Troutman
(74) *Attorney, Agent, or Firm* — Global IP Counselors, LLP

(57) ABSTRACT

A ripper device comprises a ripper bracket, a ripper cylinder, a frame component having a frame bracket, a pair of ripper links, a pair of tooth brackets, and a cylinder attachment bracket having a cylinder attachment axis. The frame bracket is connected in a state in which the head of the ripper cylinder is able to rotate, in the middle part near the ripper bracket. The cylinder attachment axis of the ripper cylinder is disposed coaxially with the rotational axis of the pair of ripper links and the pair of tooth brackets.

13 Claims, 8 Drawing Sheets

RIPPER DEVICE FOR MOTOR GRADER, AND MOTOR GRADER EQUIPPED WITH THIS DEVICE

CROSS-REFERENCE TO RELATED APPLICATIONS

This application is a U.S. National stage application of International Application No. PCT/JP2014/053358, filed on Feb. 13, 2014. This U.S. National stage application claims priority under 35 U.S.C. §119(a) to Japanese Patent Application No. 2013-232051, filed in Japan on Nov. 8, 2013, the entire contents of which are hereby incorporated herein by reference.

BACKGROUND

1. Field of the Invention

The present invention relates to a ripper device installed in a motor grader, and to a motor grader equipped with this device.

2. Background Information

A motor grader is a work vehicle for grading road or ground surfaces, removing snow, and performing other such jobs, and has a ripper device installed at the rear end.

The motor grader disclosed in U.S. Patent Application Publication No. 2013-0161036, for example, has a ripper device that employs a four-link structure, connected to the rear end portion of the body.

The ripper device in the above-mentioned publication comprises a connector connected to the body component of the motor grader, a connecting member and frame member connected at the front end parts to the upper and lower ends of the connector, a connection tower to which the rear ends of the connecting member and frame member are connected, and an actuator that imparts a drive force for raising and lowering the teeth of the ripper device.

Also, U.S. Patent Application Publication No. 2008-0245540 discloses a configuration of a ripper device comprising a pair of left and right four-bar linkages, which is driven by two left and right ripper cylinders.

SUMMARY

In the past, when a motor grader performed ripper work in which the teeth bit into the ground, there were times when this work entailed putting the teeth as far into the ground as possible, so the drive force of the actuator had to be transferred efficiently to the four-link structure.

With the ripper devices disclosed in the above-mentioned publications, the front end of the actuator was connected near the approximate center of the frame member in the forward and backward direction.

Because the expansion and contraction direction of the actuator does not coincide with the diagonal direction of the parallelogram shape of the four-link structure, and not all of the force of the actuator acts in the direction of deforming the four-bar linkages, there is a risk that enough force cannot be transmitted to actuate the ripper device.

With the ripper device configuration disclosed in U.S. Patent Application Publication No. 2008-0245540, ripper cylinders are disposed on left and right rotational shafts of the diagonal line in a pair of left and right four-bar linkages.

With this configuration, however, control of the two ripper cylinders has to be synchronized. Also, because the two ripper cylinders are disposed at positions that are shifted from the center in the width direction of the ripper device, there tends to be imbalance between the left and right sides, and controlling the ripper device may become difficult.

Furthermore, FIG. 5 in U.S. Patent Application Publication No. 2008-0245540 discloses the configuration of a ripper device that is driven by a single ripper cylinder. With this configuration, however, the rotational shaft on the bottom side of the ripper cylinder and the rotational shaft of the four-link mechanism are shifted over in a side view, there is a risk that the force when the single ripper cylinder is driven will not be efficiently transmitted to the four-link mechanism.

It is an object of the present invention to provide a ripper device for a motor grader with which the required force can be efficiently transmitted to the ripper device with just one cylinder, as well as a motor grader equipped with this ripper device.

The motor grader ripper device pertaining to a first exemplary embodiment of the present invention comprises a ripper bracket, a single ripper cylinder, a frame component, a pair of ripper links, a pair of tooth brackets, and a cylinder attachment bracket. The ripper bracket is attached to the rear end face of the body of a motor grader. The single ripper cylinder raises and lowers claw-like tooth members. The frame component is attached at the front end to the left and right sides of the lower part of the ripper bracket, and has a frame bracket connected in a state in which the head of the ripper cylinder is able to rotate, in the middle part near the ripper bracket. The pair of ripper links are attached in a state in which the front end is able to rotate with respect to the left and right sides of the upper part of the ripper bracket. With the pair of tooth brackets, the lower end is connected to the rear end at both ends in the width direction of the frame component, and the upper end is connected to the rear ends of the pair of ripper links, with the upper and lower ends both able to rotate, and the tooth members are attached to the lower ends of the tooth brackets. The cylinder attachment bracket has a cylinder attachment shaft on which the bottom part of the ripper cylinder is connected in a rotatable state in the middle part in the width direction, and is provided between the pair of tooth brackets. The cylinder attachment shaft of the ripper cylinder is disposed coaxially with the rotational shaft of the pair of ripper links and the pair of tooth brackets. The rotational shaft of the frame bracket of the head of the ripper cylinder is disposed coaxially with a pair of lower shaft supports of the ripper bracket. The ripper cylinder is disposed along a diagonal line of a parallelogram formed by the tooth brackets, the pair of ripper links, the frame component, and the ripper bracket in side view.

Here, with a motor grader ripper device that employs a four-link structure formed by the ripper bracket, the frame component, the pair of ripper links, and the tooth brackets, the head of the single ripper cylinder that drives the ripper device with a four-link structure is connected to the frame bracket of the frame component disposed near the frame bracket.

The above-mentioned "front end" means the end of each member on the front side of the body of the motor grader, and "rear end" means the end of each member on the rear side of the body of the motor grader.

Consequently, with a ripper device having a four-link structure, the expansion and contraction direction of the ripper cylinder coincides with the direction of the diagonal line of the parallelogram of the four-link structure better than with a conventional configuration in which the head of the ripper cylinder was connected near the middle of the frame component. Thus, all of the expansion and contraction force of the ripper cylinder acts in the direction of deforming the four-bar linkages, so the ripping force of the ripper device can be increased.

Also, this motor grader ripper device is such that the cylinder attachment shaft of the ripper cylinder is disposed coaxially with the rotational shaft of the pair of tooth brackets and the pair of ripper links.

Here, the cylinder attachment shaft of the ripper cylinder, that is the rotational shaft on the bottom side of the ripper cylinder, is disposed coaxially with the rotational shaft of the tooth brackets and the ripper links.

Consequently, machining is easier during manufacture of the frame component, so precision tends to be better, which suppresses stress that is exerted on the frame component.

Further, the cylinder attachment shaft that serves as the rotational shaft on the bottom side of the ripper cylinder, and the ripper bracket that serves as the rotational shaft on the head side are disposed in the middle in the width direction (left and right direction) of the ripper device.

Consequently, a single ripper cylinder that drives the ripper device can be disposed along the center in the width direction. Accordingly, there is no risk of left and right imbalance in the ripper device, and the device can be driven by simple control.

Here, the ripper device that employs a four-link structure is such that the ripper cylinder is disposed along a diagonal line of the parallelogram formed by the tooth brackets, the pair of ripper links, the frame component, and the ripper bracket in side view.

Consequently, the expansion and contraction direction of the ripper cylinder and the direction of a diagonal line of a parallelogram of the four-link structure coincide better than with a conventional configuration in which the head of the ripper cylinder was connected near the center of the frame component. Thus, all of the expansion and contraction force of the ripper cylinder acts in the direction of deforming the parallelogram, so the ripping force of the ripper device can be increased.

The motor grader ripper device pertaining to a second exemplary embodiment of the present invention is the motor grader ripper device pertaining to the first invention, wherein the ripper cylinder is connected in a rotatable state with respect to the cylinder attachment shaft, near the bottom part of the ripper cylinder.

Here, the portion near the bottom of the ripper cylinder is connected in a rotatable state with respect to the cylinder attachment shaft.

With a conventional ripper device, a state tends to occur in which the upper end of the actuator sticks up from the portion where the supports and the connecting member are linked. Accordingly, a problem that has been encountered in recent years is that there may be a dead spot in the rearview camera installed at the rear end of the body of a motor grader.

Consequently, with this ripper device, because the portion near the bottom of the ripper cylinder is connected to the cylinder attachment shaft, the bottom side of the ripper cylinder sticks out less than in the past. Thus, when a rearview camera is installed in a motor grader, there will be no dead spot in the camera caused by the bottom of the ripper cylinder.

The motor grader ripper device pertaining to a third exemplary embodiment of the present invention is the motor grader ripper device pertaining to the first or second exemplary embodiments of the present invention, wherein the rotational shaft of the ripper cylinder with respect to the frame bracket is disposed coaxially with the rotational shaft of the frame component with respect to the ripper bracket.

Here, the rotational shaft of the ripper cylinder with respect to the frame bracket, that is, the rotational shaft on the head side of the ripper cylinder, is disposed coaxially with the rotational shaft of the frame component with respect to the ripper bracket.

Consequently, machining is easier and it is easier to achieve good accuracy, so less stress is exerted on the frame component.

The motor grader ripper device pertaining to a fourth exemplary embodiment of the present invention is the motor grader ripper device pertaining to the any of the first to third inventions, wherein the frame component has a planar component and an arm component. The arm component is provided to both ends of the planar component and is connected to the tooth brackets on the rear end side and to the ripper bracket on the front end side. The frame bracket is provided on the front end side and in the middle part of the planar component between the left and right attachment components of the ripper bracket.

Here, the frame component has a planar component and an arm component provided at both ends of the planar component. The arm component is connected to the ripper bracket and the tooth brackets at the front end and rear end, respectively. Furthermore, the frame bracket to which the head of the ripper cylinder is connected is provided to the front end side in the middle of the planar component.

Consequently, as discussed above, with a ripper device having a four-link structure, the expansion and contraction direction of the ripper cylinder coincides with the direction of a diagonal line of the parallelogram of the four-link structure. Thus, all of the expansion and contraction force of the ripper cylinder acts in the direction of deforming the four-bar linkages, so the ripping force of the ripper device can be increased.

The motor grader ripper device pertaining to a fifth exemplary embodiment of the present invention is the motor grader ripper device pertaining to any of the first to fourth exemplary embodiments of the present invention, further comprising a tooth carriage that is disposed at the lower part of the pair of tooth brackets and along the left and right direction perpendicular to the travel direction, and that has excavation teeth mounted on its lower face side. The cylinder attachment bracket disposed between the pair of tooth brackets is provided on the tooth carriage along the substantially vertical direction. A shaft support that serves as the rotational shaft of the frame component is provided to the lower part of the pair of tooth brackets at a location adjacent to the portion connected to the tooth carriage.

The motor grader pertaining to a sixth exemplary embodiment of the present invention comprises the ripper device according to any of the first to fifth exemplary embodiments of the present invention, a body component to the rear end of which the ripper device is attached, and a plurality of drive wheels provided to the body component.

DETAILED DESCRIPTION OF PREFERRED EMBODIMENTS

The motor grader 1 pertaining to an exemplary embodiment of the present invention will now be described through reference to FIGS. 1 to 8*d*.

In this exemplary embodiment, the forward and backward direction shall refer to the forward and backward direction in which the motor grader 1 moves, and the left and right direction shall refer to the left and right direction in a front view in the movement direction of the motor grader 1 as seen from the cab.

Figure 1:
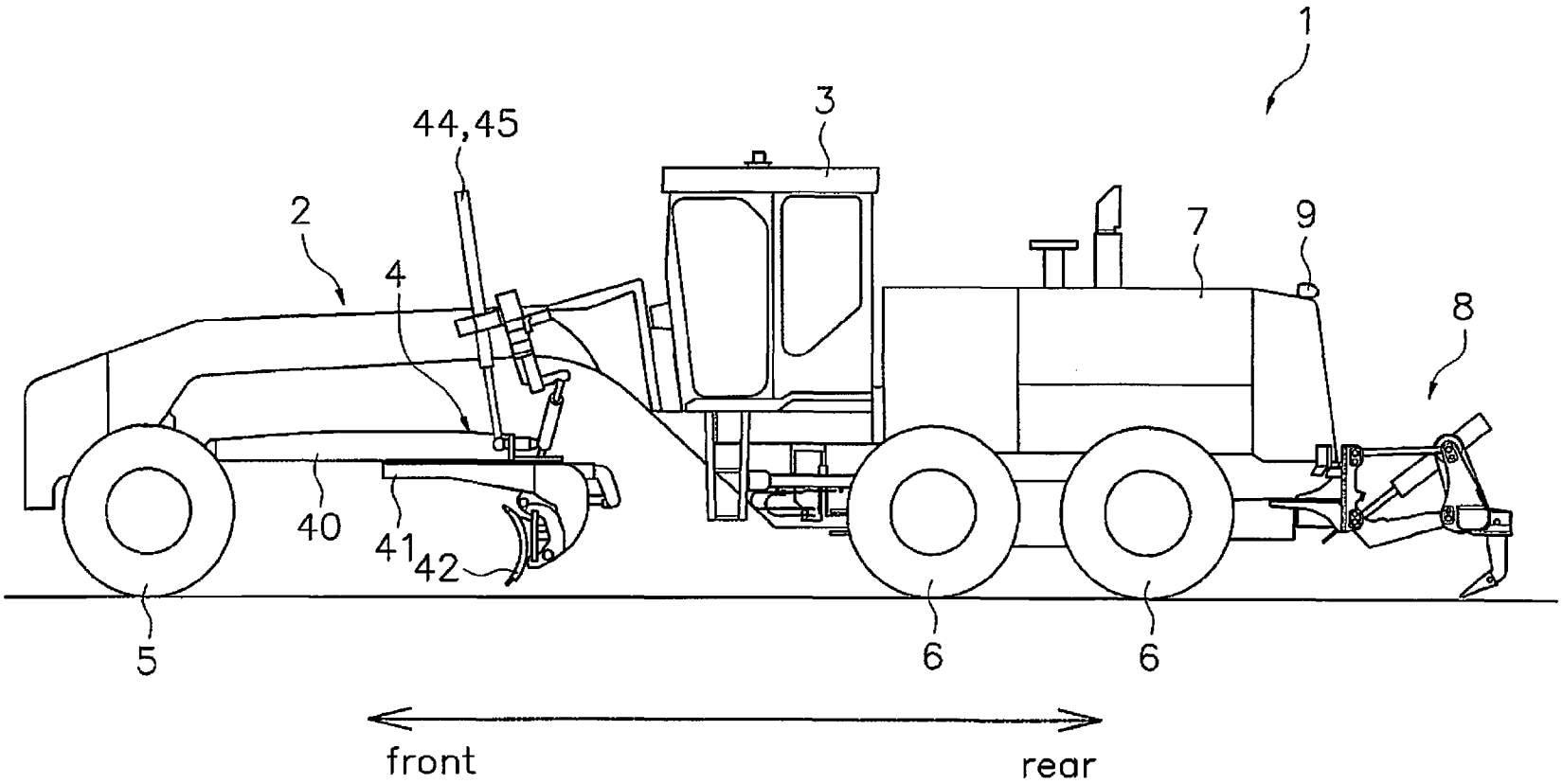
FIG. 1 is a side view of the configuration of the motor grader pertaining to an exemplary embodiment of the present invention.

Specifically, the motor grader 1 in this exemplary embodiment is a work vehicle that performs grading, snow removal, light cutting, material mixing, and other such jobs. As shown in FIG. 1, this motor grader 1 comprises a front frame 2, a cab 3, a work implement 4, a pair of front wheels 5, two pairs of left and right rear wheels 6, a body component 7, a ripper device 8, and a rearview camera 9.

The front frame 2 is provided at the front of the body of the motor grader 1, and the left and right front wheels 5 are attached to the front end thereof. The work implement 4 is also attached to the front frame 2, at the lower front side of the cab 3. The front frame 2 is attached to the front of the body component 7 in a state that allows it to articulate via a center pin (not shown).

The cab 3 has an interior space in which the operator rides, and is disposed to the rear of the front frame 2. The cab 3 may also be disposed in front of the body component 7. A steering wheel, a shift lever, control lever for the work implement 4, a brake pedal, an accelerator pedal, and other such controls are provided in the interior of the cab 3.

The work implement 4 is used to perform grading, snow removal, and other such jobs, and is attached on the front side of the cab 3 and the rear side of the front wheels 5 under the front frame 2. The work implement 4 will be described in more detail later.

The rear wheels 6 rotate upon receiving rotational drive force from an engine housed in the body component 7, thereby moving the motor grader 1.

The body component 7 houses a hydraulic drive mechanism, a power transmission mechanism such as an engine that drives the rear wheels 6, and so forth. Two pairs of left and right rear wheels 6 are attached on the left and right sides of the body component 7.

The ripper device 8 is a work implement provided for performing ground excavation work and so forth, and is attached to the rear end of the body component 7. The ripper device 8 will be described in more detail later.

The rearview camera 9 is provided to the rear end at the upper face of the body component 7 to check the situation to the rear of the body of the motor grader 1, and sends captured video to a monitor (not shown) installed inside the cab 3. This allows the operator to check the situation to the rear of the body while operating the motor grader 1 in the cab 3.

Work Implement 4

The work implement 4 has a draw drawbar 40, a circle 41, a blade 42, a hydraulic motor (not shown), a plurality of hydraulic cylinders 44 and 45, and so on.

The front end of the drawbar 40 is pivotably attached to the front end of the front frame 2. The rear end of the drawbar 40 is raised and lowered by the synchronized expansion and contraction of the pair of hydraulic cylinders 44 and 45 (see FIG. 2). Also, the drawbar 40 pivots up and down around an axis running in the travel direction of the vehicle, by providing a difference in the amount of expansion and contraction of the hydraulic cylinders 44 and 45. Furthermore, the drawbar 40 is moved to the left and right by the expansion and contraction of a drawbar shift cylinder (not shown).

The circle 41 is rotatably attached to the rear end of the drawbar 40. The circle 41 is driven by a hydraulic motor (not shown), and rotates clockwise or counter-clockwise with respect to the drawbar 40 as seen from above the vehicle.

The blade 42 is able to slide laterally with respect to the circle 41, and is supported pivotably up and down around an axis parallel to the lateral direction. The term "lateral direction" here means the left and right direction with respect to the travel direction of the motor grader 1. The blade 42 is moved in the lateral direction with respect to the circle 41 by a blade shift cylinder supported by the circle 41. Also, the blade 42 is pivoted around an axis parallel to the lateral direction with respect to the circle 41 by a tilt cylinder supported by the circle 41, to change the orientation in the up and down direction. As discussed above, the blade 42 is raised and lowered with respect to the vehicle, its inclination with respect to the travel direction is changed, its inclination with respect to the lateral direction is changed, and it is shifted in the rotation and left and right directions, via the drawbar 40 and the circle 41.

Figure 2:
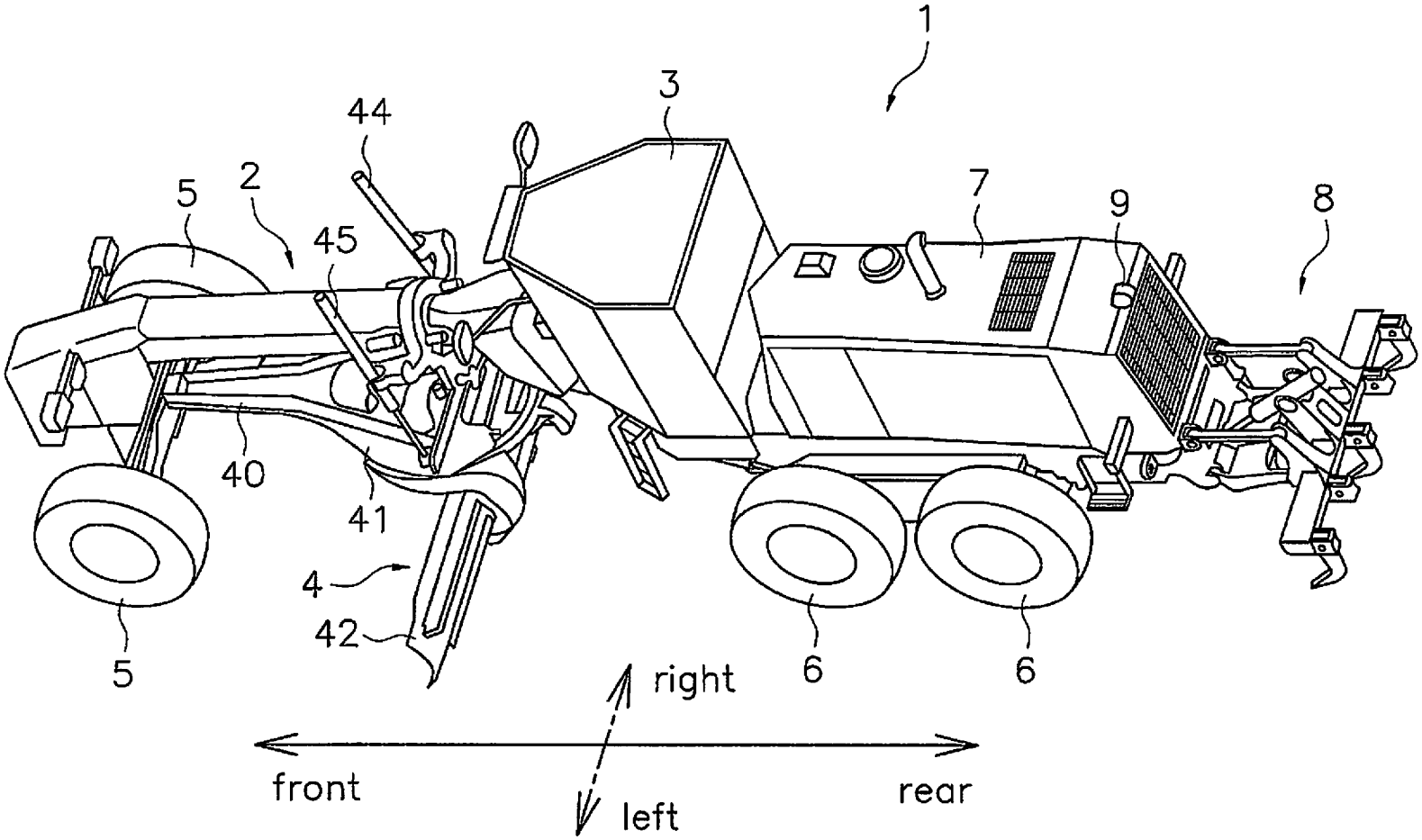
FIG. 2 is an overall oblique view of the motor grader in FIG. 1.

As discussed above, the hydraulic cylinders 44 and 45 are provided to pivot the drawbar 40 up and down, and as shown in FIG. 2, they are disposed on the left and right sides of the front frame 2, above the circle 41 and the blade 42.

Ripper Device 8

Figure 3:
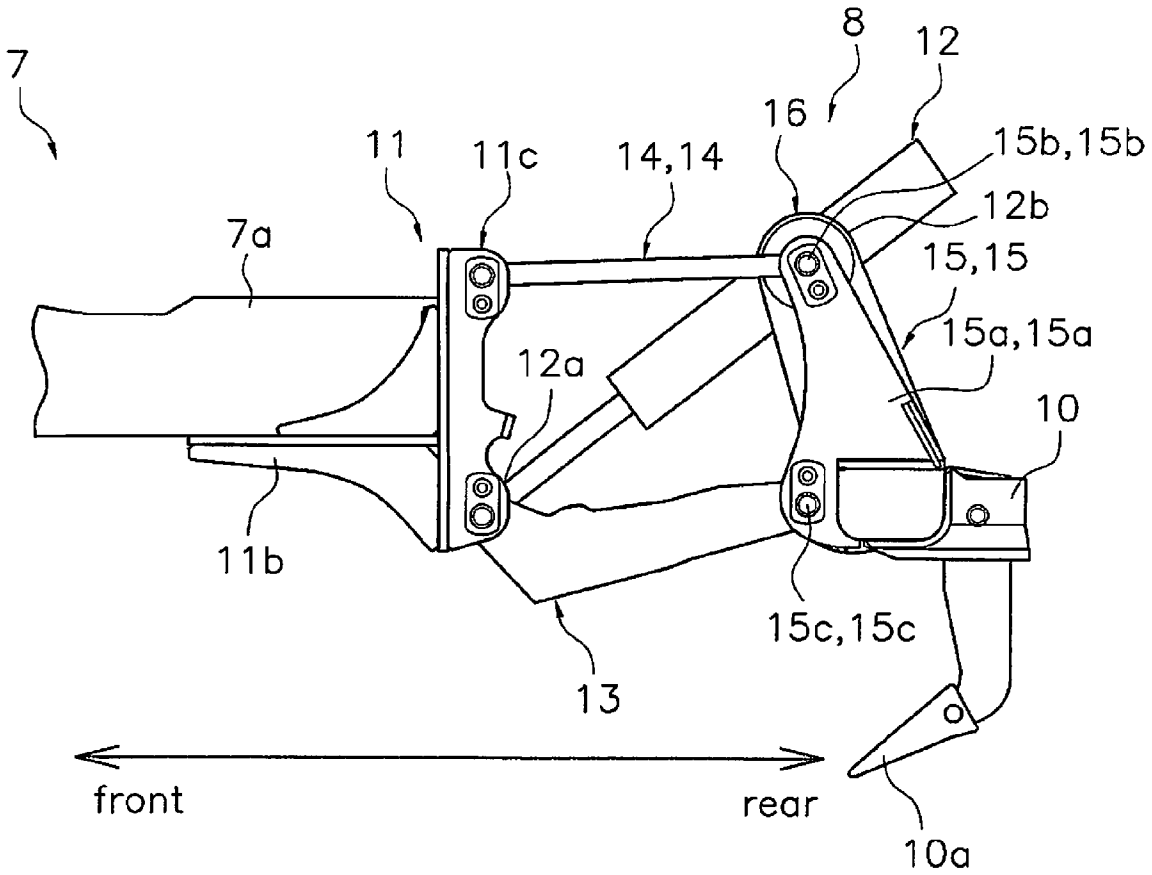
FIG. 3 is a side view of the configuration of the ripper device mounted at the rear end of the motor grader in FIGS. 1 and 2.

As shown in FIGS. 1 and 2, the ripper device 8 is attached to the rear end of the motor grader 1, and more precisely, to a rear frame 7*a* (see FIG. 3) at the rear end of the body component 7 of the motor grader 1, to perform ground excavation and other such work. As shown in FIG. 3, the ripper device 8 comprises a pair of left and right ripper links 14, a pair of left and right tooth brackets 15, and a cylinder attachment bracket 16.

As shown in FIG. 3, the ripper device 8 in this exemplary embodiment employs a four-link structure that forms a parallelogram, in side view, constituted by a ripper bracket 11 (left side), a frame component 13 (bottom side), the ripper links 14 (top side), and the tooth brackets 15 (right side). The ripper device 8 drives the various members that make up the four-link structure by the expansion and contraction of a ripper cylinder 12, and thereby raises and lowers teeth (tooth members) 10*a* with respect to the ground.

Tooth Carriage 10

Figure 4:
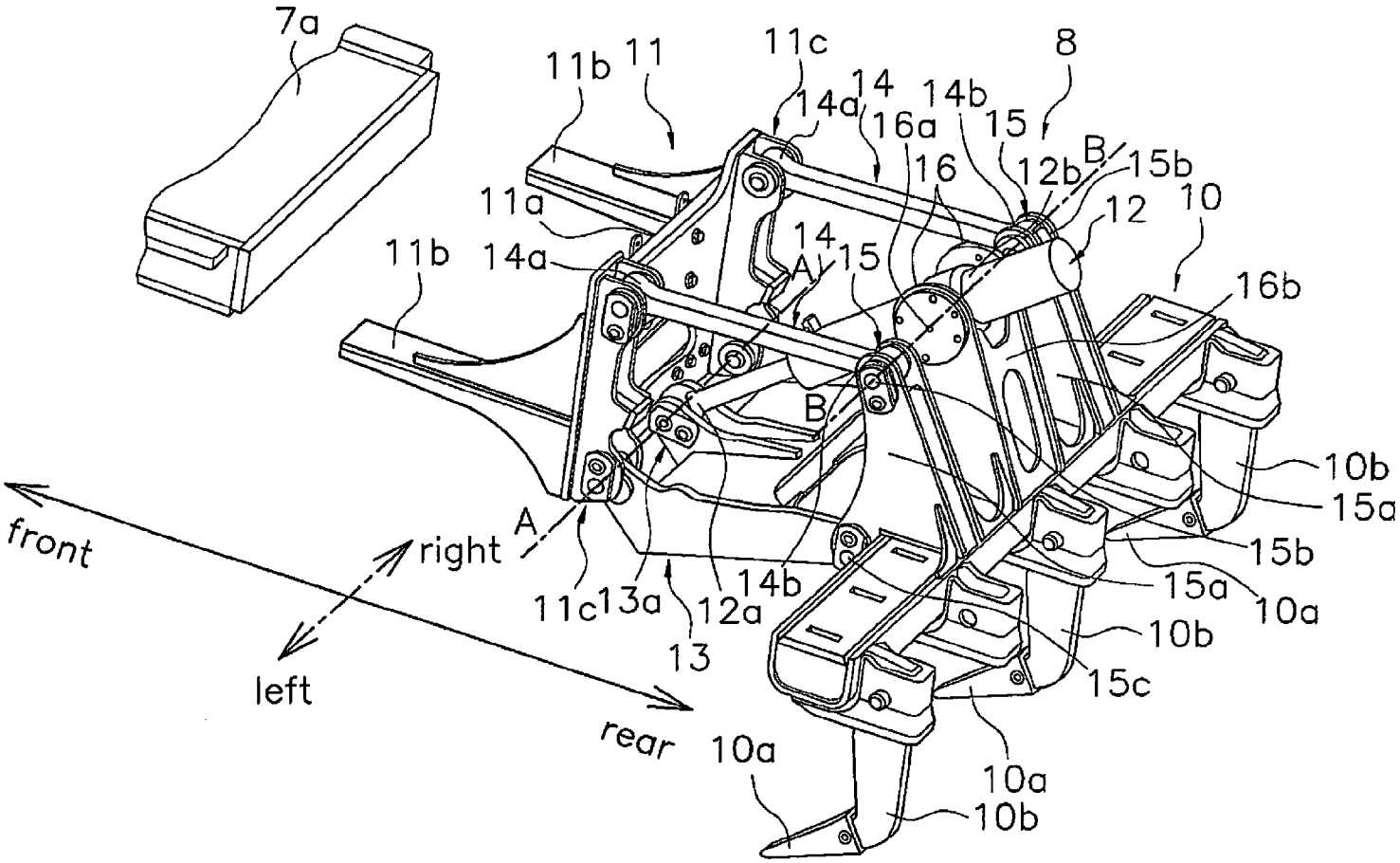
FIG. 4 is an oblique view of the ripper device in FIG. 3.

As shown in FIG. 4, a tooth carriage 10 is attached to the lower part of the pair of tooth brackets 15, and is disposed along the left and right direction perpendicular to the travel direction of the motor grader 1. The tooth carriage 10 has a shank 10*b* to which the excavation-use teeth 10*a* are mounted, in the middle and at both ends on the lower face side.

The teeth 10*a* are claw-like members that dig into the ground to perform excavation and other such work, and are attached to the shank 10*b* so that they can be replaced when needed after wear or damage incurred during excavation.

Ripper Bracket 11

Figure 5:
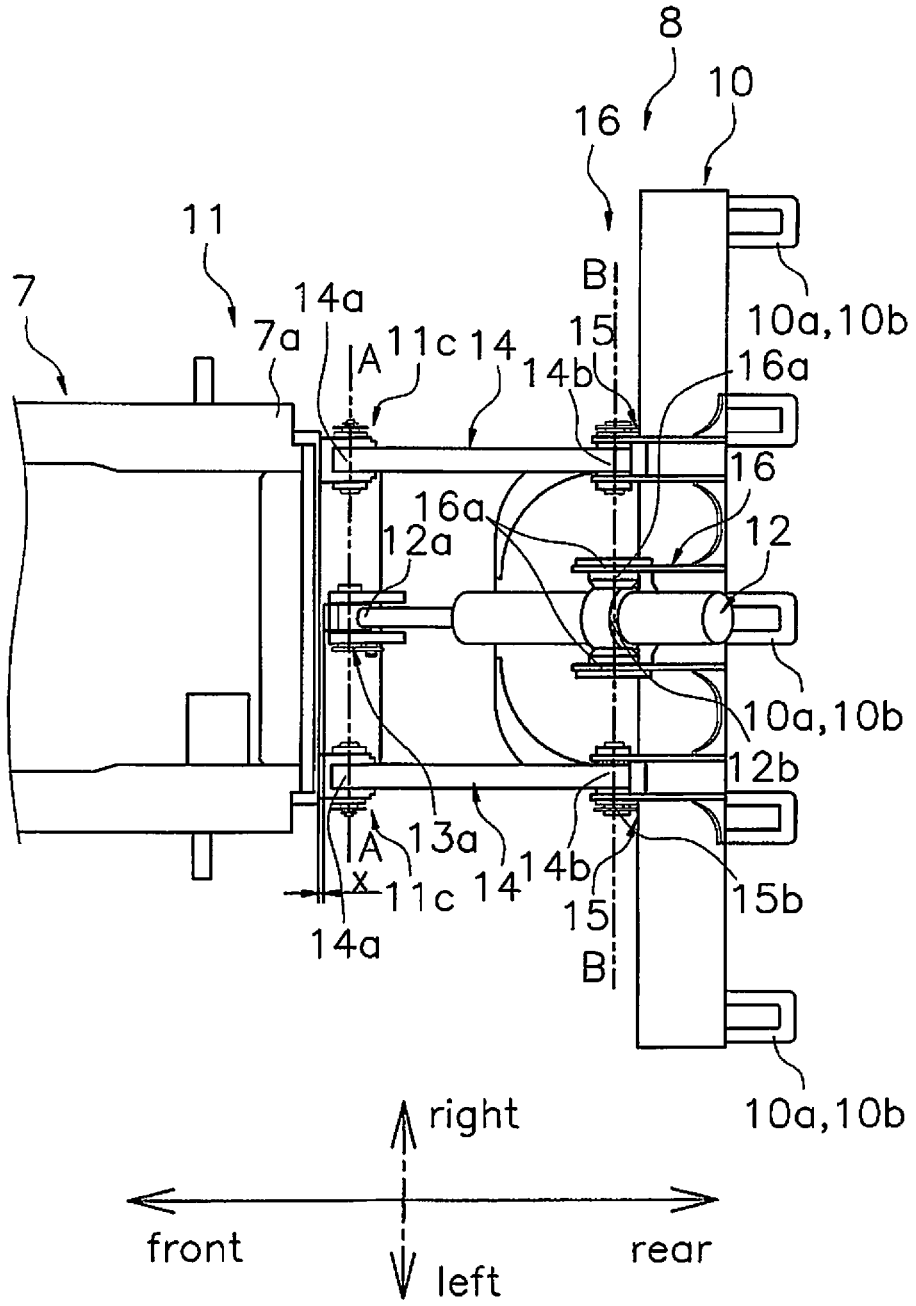
FIG. 5 is a plan view of the ripper device in FIG. 3.
Figure 6:
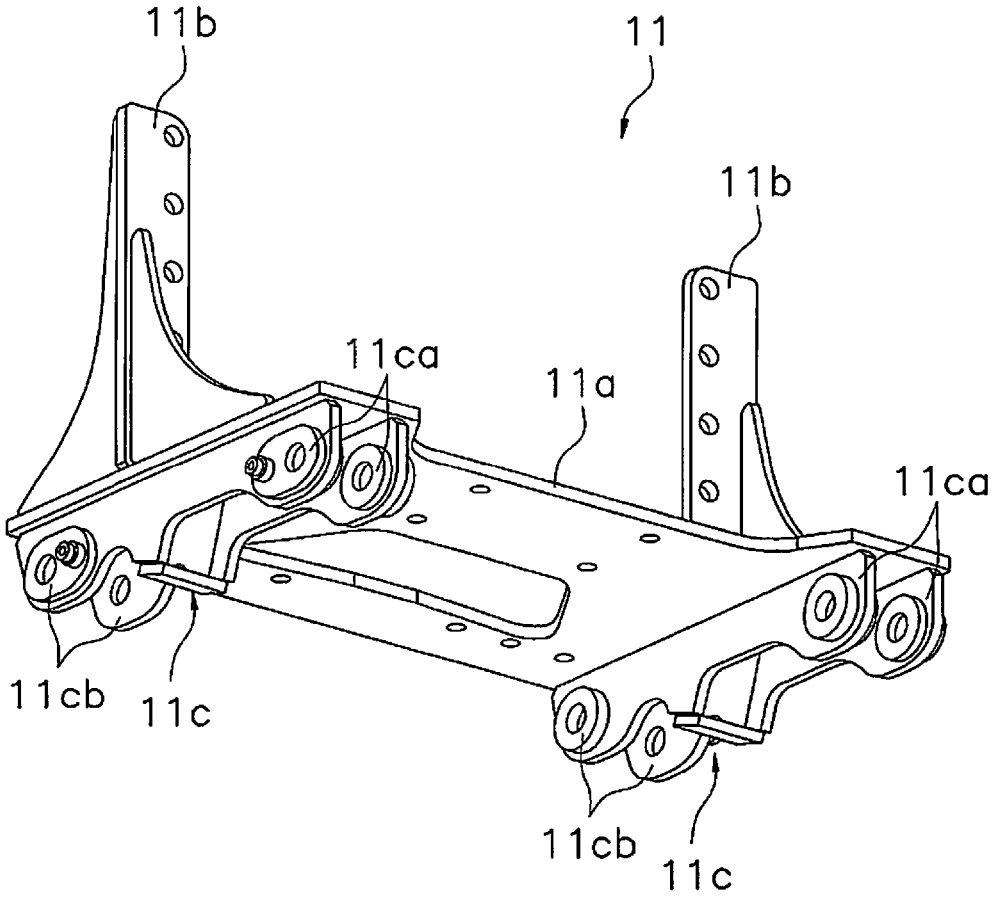
FIG. 6 is an oblique view of the ripper bracket that constitutes part of the four-link structure of the ripper device in FIG. 3.

The ripper bracket 11 is a linking member used to mount the ripper device 8 to the motor grader 1, and, as shown in FIG. 3, constitutes one link (left side) of the above-mentioned four-link structure. As shown in FIG. 5, the ripper bracket 11 is disposed close to a frame bracket 13*a* of the frame component 13 (discussed below), but not in contact, with a gap X in between. As shown in FIG. 6, the ripper bracket 11 has a flat contact component 11*a*, arm components 11*b*, and attachment components 11*c*.

The gap X between the ripper bracket 11 and the frame bracket 13*a* of the frame component 13 is set to between 10 and 20 mm. This gap X is provided to prevent interference between the ripper bracket 11 and the frame component 13, because the ripper device 8 can move.

As shown in FIG. 4, the contact component 11*a* is a flat portion disposed to come into contact with the rear end face of the motor grader 1, and as shown in FIG. 6, there are provided arm components 11*b* at the left and right ends on the rear end side (front face side) of the motor grader 1, and attachment components 11*c* at the left and right ends on the opposite side (rear face side).

The arm components 11*b* are provided to protrude from the left and right ends on the front face side of the contact component 11*a*, and the upper faces of the arm components 11*b* are fixed to the lower face of the rear frame 7*a* of the body component 7 of the motor grader 1 (see FIG. 3). This allows the ripper device 8 to be attached to the rear end of the motor grader 1.

The attachment components 11*c* are disposed along the up and down direction from the left and right ends on the rear face side of the contact component 11*a*, and shaft supports 11*ca* and 11*cb* are provided to the upper and lower ends thereof.

The shaft supports 11*ca* and 11*cb* are linked in a state that allows the rotation of the various components (the ripper links 14 and the frame component 13) that make up the four-bar linkages along with the ripper bracket 11, as discussed above.

Specifically, the pair of left and right ripper links 14 are attached rotatably with respect to the ripper bracket 11 by having the ends on the rear end side (front ends) of the motor grader 1 supported by the shaft supports 11*ca*. The frame component 13 is attached rotatably with respect to the ripper bracket 11 by having the ends on the rear end side (front ends) (shaft supports 13*ca*; see FIG. 7) of the motor grader 1 at the arm components 13*c* provided to the left and right ends supported by the shaft supports 11*cb*.

Ripper Cylinder 12

One ripper cylinder 12 is provided as a drive source for driving the ripper device 8, and is disposed along a diagonal line of the four-link structure, which forms a parallelogram in a side view as mentioned above.

More specifically, a head 12*a* of the ripper cylinder 12 is connected rotatably with respect to the frame bracket 13*a* of the frame component 13 (discussed below). On the other hand, the bottom 12*b* of the ripper cylinder 12 is connected rotatably with respect to the cylinder attachment bracket 16 (discussed below) at a position that is slightly more to the front.

Consequently, as the ripper cylinder 12 is contracted by hydraulic pressure, the teeth 10*a* are driven in the direction of digging into the ground. When the ripper cylinder 12 is extended by hydraulic pressure, the teeth 10*a* are driven away from the ground.

Also, the frame bracket 13*a* is connected in a state in which the head 12*a* of the ripper cylinder 12 is able to rotate, and the cylinder attachment bracket 16 is connected in a state in which the bottom 12*b* is able to rotate and are disposed in the middle in the width direction (left and right direction), as shown in FIG. 5.

Therefore, with the ripper device 8 in this exemplary embodiment, the single ripper cylinder 12 is disposed in the forward and backward direction in the middle in the width direction. Thus, with the configuration in this exemplary embodiment, compared to a conventional ripper device driven by two ripper cylinders, because there is no need to synchronize the left and right ripper cylinders, and there is no imbalance between the left and right sides, the ripper device 8 can be driven with a simpler configuration and control.

Frame Component 13

Figure 7:
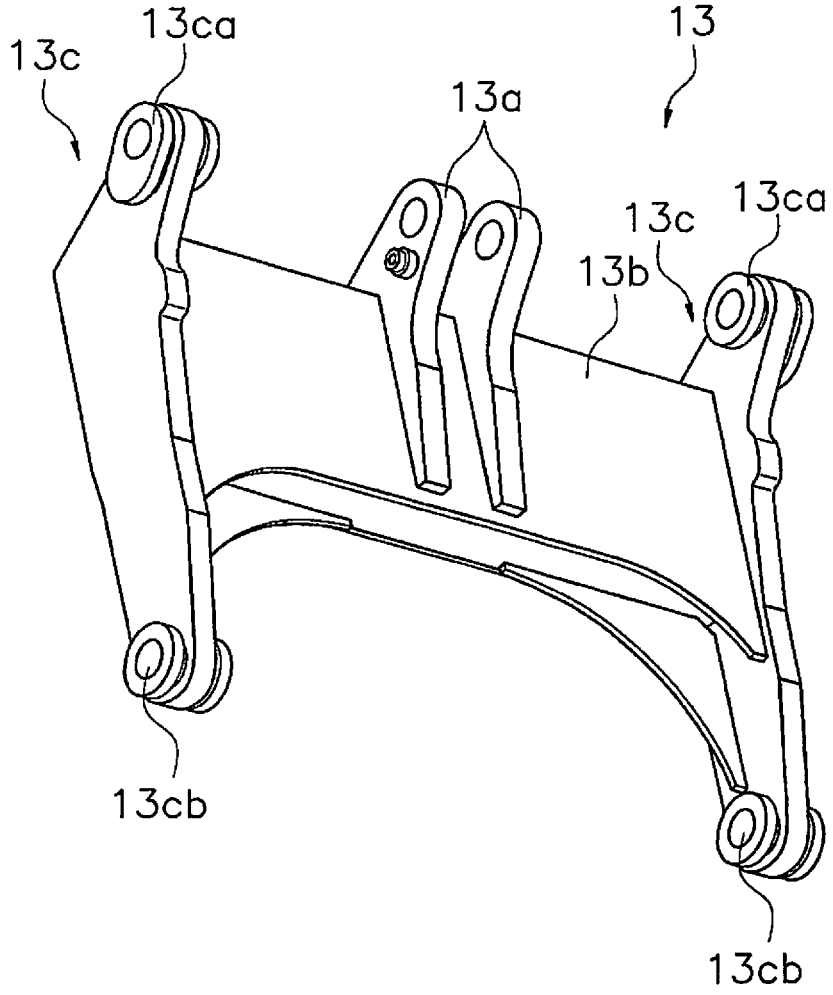
FIG. 7 is an oblique view of the configuration of the frame component that constitutes part of the four-link structure of the ripper device in FIG. 3.
Figure 8:
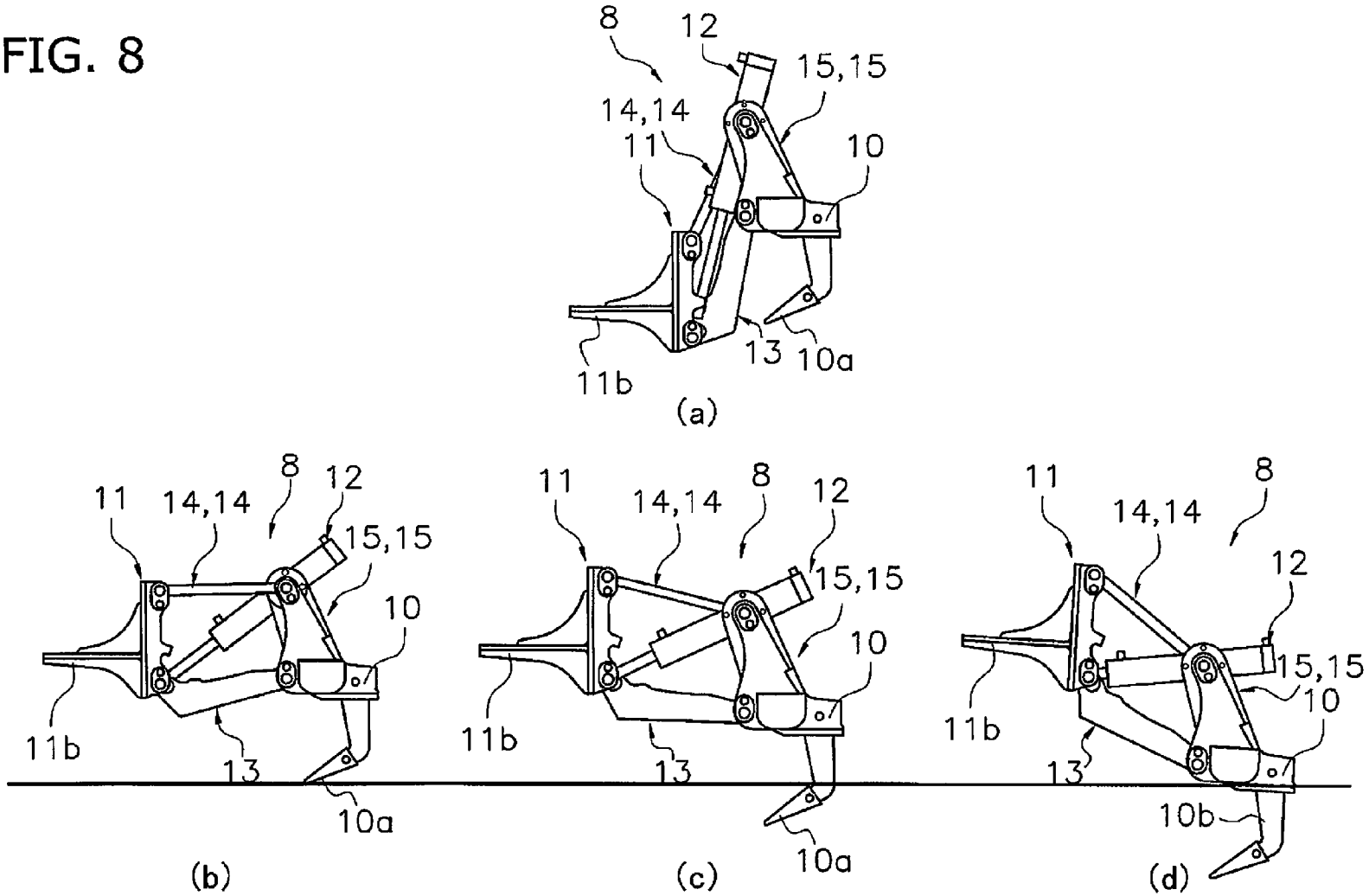
FIGS. 8*a* to 8*d* are side views of the states when the ripper links of the ripper device in FIG. 3 are raised, when the teeth are on the ground, when the teeth have penetrated the ground, and when the shank has penetrated the ground, respectively.

The frame component 13 is connected to the ripper bracket 11 at its left and right ends, and is connected to the head 12*a* of the ripper cylinder 12, and as shown in FIG. 3, constitutes one bar (lower side) of the above-mentioned four-link structure. As shown in FIG. 7, the frame component 13 has the frame bracket 13*a*, a flat part 13*b*, and the arm components 13*c*.

The frame bracket 13*a* is provided in the approximate center portion in the width direction of the frame component 13 (the left and right direction of the motor grader 1), and is connected in a state in which the head 12*a* of the ripper cylinder 12 can rotate. Also, the frame bracket 13*a* is disposed close to the above-mentioned ripper bracket 11, with the gap X in between.

The flat part 13*b* consists of a planar member in which the frame bracket 13*a* provided in the center portion and the arm components 13*c* provided at the left and right ends are integrated, and constitutes the lower side portion of the four-link structure.

The arm components 13*c* are provided at the left and right ends of the flat part 13*b*, and have shaft supports 13*ca* and 13*cb* at their ends in the forward and backward direction.

The shaft supports 13*ca* are disposed on the front side of the frame component 13, and are connected rotatably with respect to the shaft supports 11*cb* of the ripper bracket 11.

The shaft supports 13*cb* are disposed on the rear side of the frame component 13, and are connected rotatably with respect to the ends 15*c* on the lower side of the pair of tooth brackets 15.

Specifically, the frame component 13 is connected to the ripper bracket 11 at the portion of the shaft supports 13*ca* at the left and right ends, and is not in contact with the ripper bracket 11 at the frame bracket 13*a* provided in the center thereof.

Ripper Links 14

The ripper links 14 are rod-shaped members that link the ripper bracket 11 to the tooth brackets 15, and as shown in FIG. 3, they constitute one bar (the upper side) of the above-mentioned four-link structure.

More specifically, the ends 14*a* on the front side of the ripper links 14 are rotatably connected to the shaft supports 11*ca* of the ripper bracket 11. Meanwhile, the ends 14*b* on the rear side of the ripper links 14 are connected rotatably with respect to the ends (the shaft supports 15*b*) on the upper side of the tooth brackets 15.

Tooth Brackets 15

The tooth brackets 15 are connected at their upper ends to the ripper links 14 and at their lower ends to the frame component 13, and as shown in FIG. 3, they constitute one bar (the right side) of the above-mentioned four-link structure. Also, the tooth brackets 15 are connected to the tooth carriage 10 at the lower ends. As shown in FIG. 4, the tooth brackets 15 have a pair of left and right main body components 15*a*, a pair of left and right shaft supports 15*b*, and a pair of left and right shaft supports 15*c*.

The main body components 15*a* are formed to extend substantially perpendicularly from the tooth carriage 10, and are provided at their upper ends with the shaft supports 15*b* and at their lower ends with the shaft supports 15*c*. The lower ends of the main body components 15*a* are connected to the upper face of the tooth carriage 10, and support the tooth carriage 10. Furthermore, the main body components 15*a* are disposed to flank the cylinder attachment bracket 16.

The shaft supports 15*b* are connected to the ends 14*b* of the ripper links 14, and axially support the ripper links 14 in a rotatable state.

The shaft supports 15*c* are provided at positions adjacent to the connection portion with the tooth carriage 10. The shaft supports 15*c* are also connected to the shaft supports 13*cb* of the frame component 13, and axially support the frame component 13 in a rotatable state.

Cylinder Attachment Bracket 16

The cylinder attachment bracket 16 is provided between the left and right tooth brackets 15 to support the bottom 12*b* of the ripper cylinder 12, extends from the tooth carriage 10 in a substantially vertical direction similarly to the main body components 15*a* of the tooth brackets 15, and as shown in FIG. 4, has a cylinder attachment shaft 16*a* and a main body component 16*b*.

The cylinder attachment shaft 16*a* is axially supported in the left and right direction at positions slightly to the inside of the bottom 12*b* of the ripper cylinder 12, and is attached in a state in which the ripper cylinder 12 can rotate.

The main body component 16*b* is provided on the tooth carriage 10, and the cylinder attachment shaft 16*a* is provided to the upper end portion.

Layout of Rotational Shafts in Four-Link Structure

With the ripper device 8 in this exemplary embodiment, as discussed above, a four-link structure is formed by the ripper bracket 11, the frame component 13, the left and right ripper links 14, and the left and right tooth brackets 15. These members are linked together via rotational shafts.

As shown in FIGS. 4 and 5, with the four-link structure in this exemplary embodiment, the frame bracket 13*a*, which is used to connect the head 12*a* of the ripper cylinder 12 to the frame component 13, is disposed to be as close as possible to the body component 7 side (ripper bracket 11) of the motor grader 1.

Also, the rotational shaft connecting the ripper bracket 11 (the shaft supports 11*cb*) and the frame component 13 (the shaft supports 13*ca*) is disposed coaxially with the rotational shaft of the frame bracket 13*a* connected to the head 12*a* of the ripper cylinder 12 with respect to the frame component 13.

Furthermore, the rotational shaft on which the ends 14*b* on the rear side of the ripper links 14 and the shaft supports 15*b* of the tooth brackets 15 are connected is disposed coaxially with the cylinder attachment shaft 16*a* of the cylinder attachment bracket 16 connected near the ends 12*b* on the front and rear sides of the ripper cylinder 12.

Consequently, machining is easier and it is easier to achieve good accuracy, so less stress is exerted on the frame component.

Main Features

The ripper device 8 in this exemplary embodiment employs a four-link structure made up of the ripper bracket 11, the frame component 13, the left and right ripper links 14, and the left and right tooth brackets 15. As shown in FIG. 3, the ripper device 8 is such that the various members are linked together via rotational shafts, forming a parallelogram in side view. Also, in this exemplary embodiment, because the head 12*a* of the ripper cylinder 12 that serves as the drive source to the ripper device 8 that employs this four-link structure is connected to the frame component 13, the frame bracket 13*a* is disposed to be as close as possible to the body component 7 side of the motor grader 1.

Consequently, compared to a conventional ripper device in which the end on the front side of the ripper cylinder was connected near the approximate center of the frame component, the cylinder stroke of the ripper cylinder 12 can be increased. Furthermore, with the ripper device 8 having a four-link structure, compared to a conventional configuration in which the head of the ripper cylinder was connected near the center of the frame component, the expansion and contraction direction of the ripper cylinder 12 can coincide better with the direction of a diagonal line of the parallelogram of the four-link structure. Accordingly, all of the expansion and contraction force of the ripper cylinder can act in the direction of deforming the four-bar linkages.

In ripper work, enough force to lift up the body is required for the teeth to dig all the way into the ground, and the ripping force required during ripping work can be ensured even when the body weight is increased by the installation of a reductant (urea water) tank or the like.

Also, the stress exerted on the frame component 13 when the ripper cylinder 12 expands and contracts can be reduced by providing the frame bracket 13*a* that is used to connect the head 12*a* of the ripper cylinder 12 to the frame component 13 at the front-most end of the frame component 13. This simplifies the configuration of the ripper device 8.

Furthermore, with the ripper device 8 in this exemplary embodiment, the head 12*a* and the bottom 12*b* of the ripper cylinder 12 are connected to the frame bracket 13*a* and the cylinder attachment bracket 16 disposed in the center in the width direction (left and right direction).

Consequently, the single ripper cylinder 12 can be disposed along the forward and backward direction in the center in the width direction. This eliminates the risk of left and right imbalance in the ripper device 8, and allows the ripper device 8 to be driven by a simple configuration and control.

With a conventional ripper device, a state tends to occur in which the bottom part of the ripper cylinder sticks up in side view from the portion where the connecting member and the connecting tower are linked. Therefore, a problem that has been encountered in recent years is that there may be a dead spot in the rearview camera installed at the rear end of the body of a motor grader.

In view of this, with the motor grader 1 equipped with the ripper device 8 of this exemplary embodiment, as discussed above, the end 12*a* on the front side of the ripper cylinder 12 is disposed as far forward as possible to ensure the maximum cylinder stroke. Therefore, the end 12*b* on the rear side of the ripper cylinder 12 can be such that the portion that sticks up is made smaller than the cylinder shaft support more than in the past.

As a result, as shown in FIG. 1 and elsewhere, this avoids a dead spot being formed by the end 12*b* of the ripper cylinder 12 in the rearward field of view captured by the rearview camera 9 attached to the rear end portion at the upper face of the body component 7 of the motor grader 1. Thus, an adequate field of view can be ensured in the rearview camera 9.

Usage State of Ripper Device 8

The state in which the ripper device 8 configured as above is used will now be described through reference to FIGS. 8*a* to 8*d*.

First, when the ripper links 14 have been raised, as shown in FIG. 8*a*, the ripper cylinder 12 and the ripper links 14 are tilted at a slight angle from the approximately vertical direction.

Next, as shown in FIG. 8*b*, when the teeth 10*a* have come into contact with the ground, the frame component 13 and the ripper links 14 are substantially parallel to the approximately horizontal direction.

In this state, the angle formed by the frame component 13 and the center axis of the ripper cylinder 12 is approximately 35 degrees in side view.

Next, when the teeth 10*a* have penetrated the ground, as shown in FIG. 8*c*, the ripper cylinder 12 contracts from the state shown in FIG. 8*b*, resulting in a state in which the frame component 13 and the ripper links 14 have rotated downward below the approximately horizontal direction. This allows the teeth 10*a* mounted to the distal end of the tooth carriage 10 to penetrate the ground.

In this state, the angle formed by the frame component 13 and the center axis of the ripper cylinder 12 is approximately 40 degrees in side view.

Also, when the shank 10*b* mounted to the distal end of the tooth carriage 10 penetrates the ground, the resulting state is one in which the tooth carriage 10 is brought closer to the surface of the ground than in the state shown in FIG. 8*c*, so as shown in FIG. 8*d*, the frame component 13 and the ripper links 14 have been rotated downward at an angle of approximately 45 degrees below the approximately horizontal direction. This allows the shank 10*b* mounted to the distal end of the tooth carriage 10 to penetrate deep under the surface of the ground.

In this state, the angle formed by the frame component 13 and the center axis of the ripper cylinder 12 is approximately 45 degrees in side view. Also, in this state the ripper cylinder 12 is substantially housed.

The ripper device of the exemplary embodiments of the present invention has the effect of ensuring that the required ripping force will be obtained during ripper work even when the body weight has increased, and therefore can be widely applied to various kinds of ripper devices.

The invention claimed is:

1. A ripper device for a motor grader, comprising:

a ripper bracket configured to be attached to a rear end face of the body of a motor grader, the ripper bracket including a pair of lower shaft supports disposed at lower portions of left and right sides of the ripper bracket;

a single ripper cylinder configured to raise and lower tooth members, the ripper cylinder having a head at one end and a bottom part at an opposite end;

a frame component rotatably attached at a front end to the lower shaft supports of the ripper bracket, the frame component having a frame bracket connected to the ripper cylinder in a state in which the head of the ripper cylinder is able to rotate, the frame bracket being disposed in a widthwise middle part of the frame component near the ripper bracket;

a pair of ripper links attached to the ripper bracket such that front ends of the ripper links are able to rotate with respect to the left and right sides of an upper part of the ripper bracket;

a pair of tooth brackets, to a lower end of which the tooth members are attached, and whose lower end is connected to a rear end of the frame component at both ends of the frame component in a width direction of the frame component, and whose upper end is connected to rear ends of the pair of ripper links, with the upper and lower ends of the tooth brackets both able to rotate with respect to the frame component and the ripper links; and a cylinder attachment bracket having a cylinder attachment shaft to which the bottom part of the ripper cylinder is connected in a rotatable state in a middle part in the width direction of the motor grader, the cylinder attachment bracket being provided between the pair of tooth brackets, the cylinder attachment shaft of the ripper cylinder being disposed coaxially with rotational shafts of the pair of ripper links and the pair of tooth brackets, the cylinder attachment shaft being separate and spaced apart from the rotational shafts of the pair of ripper links and the pair of tooth brackets, a rotational shaft of the frame bracket with respect to the head of the ripper cylinder being disposed coaxially with the pair of lower shaft supports of the ripper bracket, the rotational shaft of the frame bracket with respect to the head of the ripper cylinder being separate and spaced apart from the lower shaft supports, and the ripper cylinder being disposed along a diagonal line of a parallelogram formed by the tooth brackets, the pair of ripper links, the frame component, and the ripper bracket in side view.

2. The ripper device for a motor grader according to claim 1, wherein the ripper cylinder is connected in a rotatable state with respect to the cylinder attachment shaft and near the bottom part of the ripper cylinder.

3. The ripper device for a motor grader according to claim 1, wherein the rotational shaft of the ripper cylinder with respect to the frame bracket is disposed coaxially with the rotational shaft of the frame component with respect to the ripper bracket.

4. The ripper device for a motor grader according to claim 1, wherein the frame component has a planar component; and an arm component provided to both ends of the planar component and connected to the tooth brackets on the rear end side and to the ripper bracket on the front end side, and the frame bracket is provided on the front end side and in the middle part of the planar component between a left attachment component and a right attachment component of the ripper bracket.

5. The ripper device for a motor grader according to claim 1, further comprising a tooth carriage disposed at a lower part of the pair of tooth brackets and extending along a left and right direction perpendicular to a travel direction, and that has excavation teeth mounted on its lower face side, wherein the cylinder attachment bracket disposed between the pair of tooth brackets is provided on the tooth carriage along a substantially vertical direction, and a shaft support that serves as the rotational shaft of the frame component is provided to the lower part of the pair of tooth brackets at a location adjacent to the portion connected to the tooth carriage.

6. A motor grader, comprising:

the ripper device according to claim 1;

a body component to a rear end of which the ripper device is attached; and a plurality of drive wheels provided to the body component.

7. The ripper device for a motor grader according to claim 2, wherein the rotational shaft of the ripper cylinder with respect to the frame bracket is disposed coaxially with the rotational shaft of the frame component with respect to the ripper bracket.

8. The ripper device for a motor grader according to claim 2, wherein the frame component has a planar component; and an arm component provided to both ends of the planar component and connected to the tooth brackets on the rear end side and to the ripper bracket on the front end side, and the frame bracket is provided on the front end side and in the middle part of the planar component between a left attachment component and a right attachment component of the ripper bracket.

9. The ripper device for a motor grader according to claim 2, further comprising a tooth carriage disposed at a lower part of the pair of tooth brackets and extending along a left and right direction perpendicular to a travel direction, and that has excavation teeth mounted on its lower face side, wherein the cylinder attachment bracket disposed between the pair of tooth brackets is provided on the tooth carriage along a substantially vertical direction, and a shaft support that serves as the rotational shaft of the frame component is provided to the lower part of the pair of tooth brackets at a location adjacent to the portion connected to the tooth carriage.

10. A motor grader, comprising:

the ripper device according to claim 2;

a body component to a rear end of which the ripper device is attached; and a plurality of drive wheels provided to the body component.

11. The ripper device for a motor grader according to claim 1, the ripper bracket including a flat contact component configured to be attached in contact with the rear end face of the body of the motor grader, the pair lower shaft supports being provided on left and right sides of flat contact component, a bottommost edge of the flat contact component being disposed lower than the rotational shaft of the frame bracket with respect to the head of the ripper cylinder when the ripper bracket is attached to the motor grader.

12. The ripper device for a motor grader according to claim 1, wherein the frame bracket is arranged in a non-contacting state with respect to the ripper bracket such that a gap exists between the frame bracket and the ripper bracket.

13. A ripper device for a motor grader, comprising:

a ripper bracket configured to be attached to a rear end face of the body of a motor grader;

a single ripper cylinder configured to raise and lower tooth members;

a frame component attached to the ripper bracket at a front end to left and right sides of a lower part of the ripper bracket, the frame component having a frame bracket connected to the ripper cylinder in a state in which a head of the ripper cylinder is able to rotate, the frame bracket being disposed in a widthwise middle part of the frame component at a position near the ripper bracket such that the frame bracket is disposed between and spaced apart from the pair of lower shaft supports, the frame bracket being arranged in a non-contacting state with respect to the ripper bracket such that a gap exists between the frame bracket and the ripper bracket;

a pair of ripper links each having a front end and a rear end, the front ends of the ripper links being rotatably attached to the ripper bracket such the ripper links are able to rotate with respect to the left and right sides of an upper part of the ripper bracket;

a pair of tooth brackets each having a lower end and an upper end, the lower ends of the tooth brackets being attached to the tooth members and rotatably connected to a rear end of the frame component at both widthwise ends of the frame component, the upper ends of the tooth brackets being rotatably connected to rear ends of the pair of ripper links; and a cylinder attachment bracket having a cylinder attachment shaft to which a bottom part of the ripper cylinder is connected in a rotatable state, the cylinder attachment bracket being provided midway between the pair of tooth brackets in a width direction of the motor grader such that the cylinder attachment bracket is spaced apart from each of the tooth brackets, the cylinder attachment shaft of the ripper cylinder being disposed coaxially with rotational shafts of the pair of ripper links and the pair of tooth brackets, the cylinder attachment shaft being separate and spaced apart from the rotational shafts of the ripper links and the tooth brackets, a rotational shaft of the frame bracket with respect to the head of the ripper cylinder being disposed coaxially with a pair of lower shaft supports of the ripper bracket, the rotational shaft of the frame bracket with respect to the head of the ripper cylinder being disposed between and spaced apart from the lower shaft supports in the width direction of the frame component, and the ripper cylinder being disposed along a diagonal line of a parallelogram formed by the tooth brackets, the pair of ripper links, the frame component, and the ripper bracket in a side view of the motor grader.

* * * * *